US005593327A

United States Patent [19]

Hlinsky et al.

[11] Patent Number: 5,593,327

[45] Date of Patent: Jan. 14, 1997

[54] CABLE CONNECTOR

[75] Inventors: Emil J. Hlinsky, Oak Brook; Yury Galperin, Niles, both of Ill.

[73] Assignee: MacLean-Fogg Company, Mundelein, Ill.

[21] Appl. No.: 511,358

[22] Filed: Aug. 4, 1995

[51] Int. Cl.[6] ..... H01R 4/36

[52] U.S. Cl. ..... 439/811; 439/793

[58] Field of Search ..... 439/803, 811, 439/792, 793, 812

[56] References Cited

U.S. PATENT DOCUMENTS

| | | | |
|---|---|---|---|
| 4,103,986 | 8/1978 | Izraeli | 439/811 |
| 4,105,272 | 8/1978 | West et al. | 439/803 |
| 4,911,572 | 3/1990 | Williams | 439/803 |
| 5,015,205 | 5/1991 | Franks, Jr. | 439/803 |
| 5,021,612 | 6/1991 | Joffe | 174/146 |
| 5,042,391 | 8/1991 | Kahl | 104/113 |

*Primary Examiner*—Neil Abrams
*Assistant Examiner*—Eugene Byrd
*Attorney, Agent, or Firm*—Mason, Kolenmainen, Rathburn & Wyss

[57] ABSTRACT

A cable connector includes a base and two upstanding posts, each carrying a cable retention arm spaced above and parallel to the base. The arms extend in opposite directions, flanking a cable entry slot. The connector is place on a cable with the cable in the entry slot, and the connector is then moved ninety degrees to locate the cable in a cable retention path extending beneath the arms. A clamp plate is moved from the base toward the arms to clamp the cable against the arms. Applications for the connector include a spacer for power distribution cables and splicing two cables together.

19 Claims, 3 Drawing Sheets

CABLE CONNECTOR

FIELD OF THE INVENTION

The present invention relates to an improved cable connector and to improved cable spacers and cable splice assemblies using the improved cable connector.

DESCRIPTION OF THE PRIOR ART

In installations of cables such as electrical transmission cables, support cables and others, a need arises to make a secure, fixed connection to one or more cables. For example, under some circumstances it is desirable to maintain a spacing between a plurality of overhead power transmission and distribution wires. U.S. Pat. No. 5,021,612 discloses a cable spacer for overhead power cables including rotatable blocks for attaching the spacer to cables. Other devices of this class include various structures for clamping or otherwise attaching spacers to cables. Such devices have been cumbersome and hard to install, particularly with hot stick tools required for installing the device to live power cables.

In other types of installations, it may be necessary to clamp a cable connector or cable clamp to a support cable in order to support another cable or conductor. U.S. Pat. No. 5,015,205 discloses a cable clamp providing a mechanical connection between a support wire and a telephone cable lashing wire. Similar clamps have been used for attachments to messenger cables and support cables of various types. Such clamps and connectors are inconvenient and difficult to install. For one thing, such devices are not supported on the cable and must be held in place until the cable is clamped in the device.

In the past a device known as a split bolt has been used to make a fixed connection to a cable or to attach two cables together. This device has a threaded shank with an axial slot extending inward from its end. One or more cables are received in the slot, and a nut may be threaded over the shank to close the slot and capture and clamp the cable or cables in the slot. This device suffers from disadvantages including difficulty and complexity in installation, and is not well suited for installation with hot stick tools.

SUMMARY OF THE INVENTION

A principal object of the present invention is to provide a cable connector that is easy to install in a fixed position on a cable, even using cumbersome hot stick tools. Other objects are to provide a cable connector that supports itself on a cable prior to being clamped in place; to provide a cable connector that can be used in various installations such as attaching two cables together or attaching a spacer to cables; and to provide a cable connector that is sturdy, simple and reliable and that overcomes disadvantages of cable connectors and similar devices used in the past.

In brief, in accordance with the present invention there is provided a cable connector for attachment to a cable. The cable connector includes a base lying in an X-Y plane of a generally orthogonal X-Y coordinate system. A pair of cable retention structures each include an upstanding post and a cable retention arm extending from the post. The upstanding posts extend from the base at locations spaced apart from one another along both the X and Y axes. The cable retention arms are spaced from the base and are generally parallel to one another and extend from the posts in opposite X axis directions. Each cable retention arm has a free end opposed in the Y direction from the post of the other cable retention structure. A cable entry slot extends in the X axis direction between the cable retention arms and between the posts. A cable retention path extends in the Y axis direction above the base and beneath the cable retention arms and between the posts. Means are provided for clamping a cable against the cable retention arms.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

Figure 1:
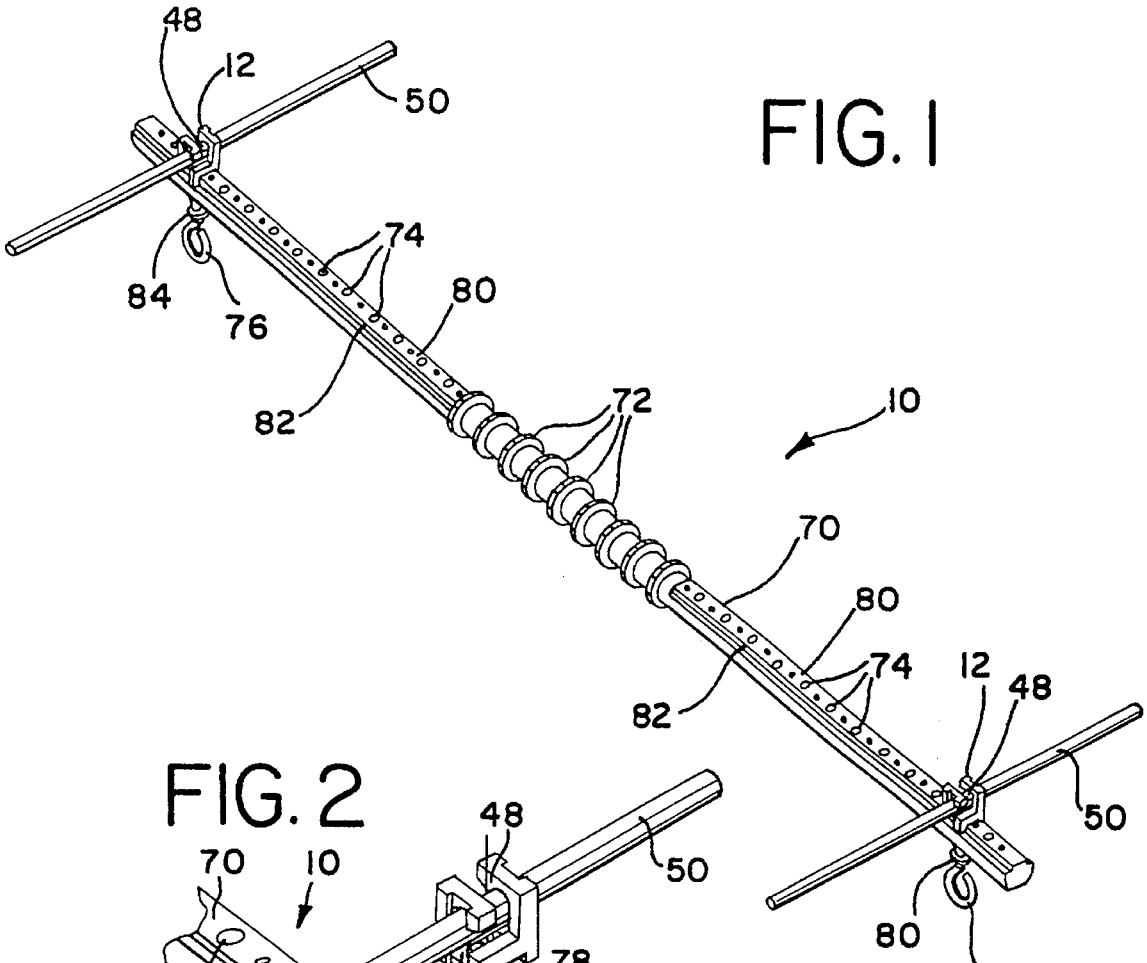
FIG. 1 is an isometric view of a primary phase cable spacer including cable connectors constructed in accordance with the present invention.
Figure 2:
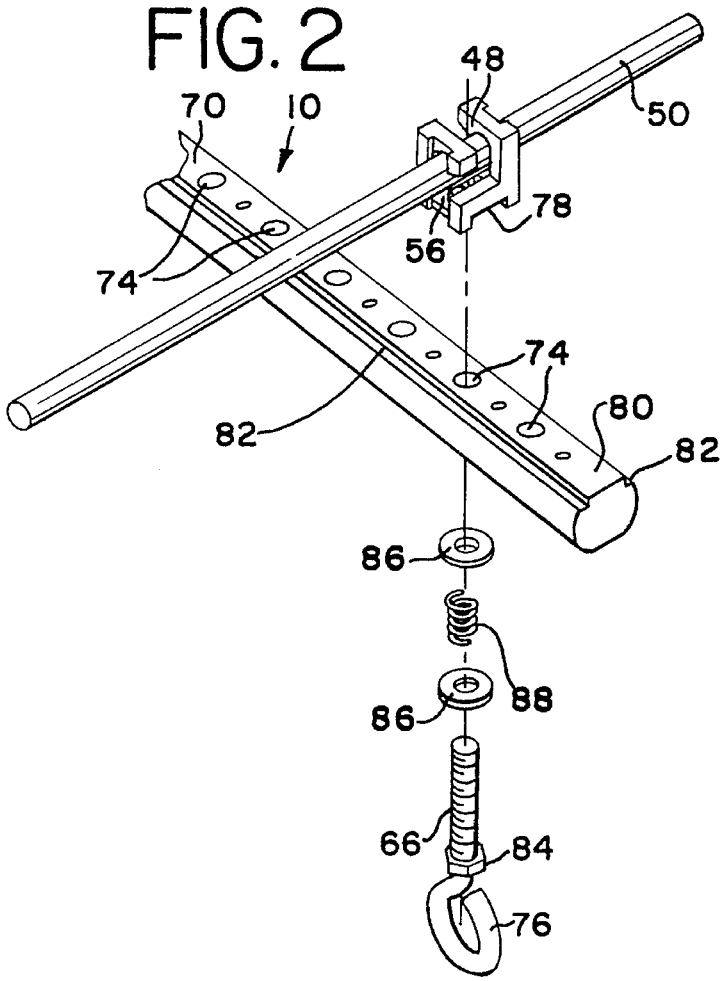
FIG. 2 is an enlarged, exploded isometric view of an end of the spacer and one cable connector of FIG. 1.
Figure 3:
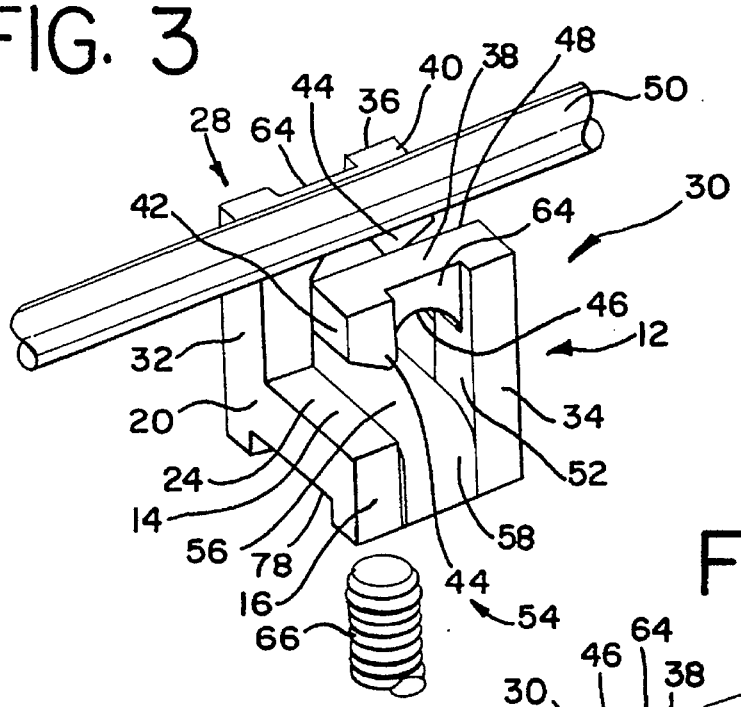
FIGS. 3, 4 and 5 are enlarged isometric views showing sequential steps performed in attaching the cable connector to a cable.

Having reference now to the drawings, in FIGS. 1 and 2 there is illustrated a primary phase cable spacer 10 constructed in accordance with the invention and including a pair of spaced apart cable connectors 12 constructed in accordance with the present invention. The structure and use of the cable connectors 12 appears in FIGS. 3–8 wherein one of the cable connectors 12 is illustrated.

Cable connector 12 includes a generally planar base portion 14. As an aid to the description and understanding of the present invention, the elements of the cable connector can be considered with reference to an orthogonal X-Y coordinate system. In the illustrated arrangement the base 14 is rectangular and lies in an X-Y plane. The base portion 14 includes opposed side walls 16 and 18 extending in the X axis direction and alternate opposed side walls 20 and 22 extending in the Y axis direction, although other base portion shapes are possible. Base portion 14 also includes top and bottom walls 24 and 26.

A pair of cable retention structures 28 and 30 are supported by the base portion 14. Retention structures 28 and 30 respectively include posts 32 and 34 extending up from the base portion 14. The posts 32 and 34 extend from regions on the base 14 that are spaced in both the X and Y axis directions. Stated another way, in the illustrated arrangement, the posts 32 and 34 are catercorner or adjacent diametrically opposed corners of the rectangular base portion 14.

Cable retention structures 28 and 30 also include cable retention arms 36 and 38 extending respectively from the tops of the posts 32 and 34. These arms 36 and 38 are spaced above the top wall 24 of the base portion 14 and extend parallel to one another in opposite X axis directions. Arm 36 extends from post 32 and has a free end 40 spaced in the Y direction from post 34. Arm 38 extends from post 34 and has a free end 42 spaced in the Y direction from post 32. A lip 44 is provided adjacent each free end 40 and 42, and the underside of each cable retention arm 36 and 38 is configured as a cradle 46.

Figure 4:
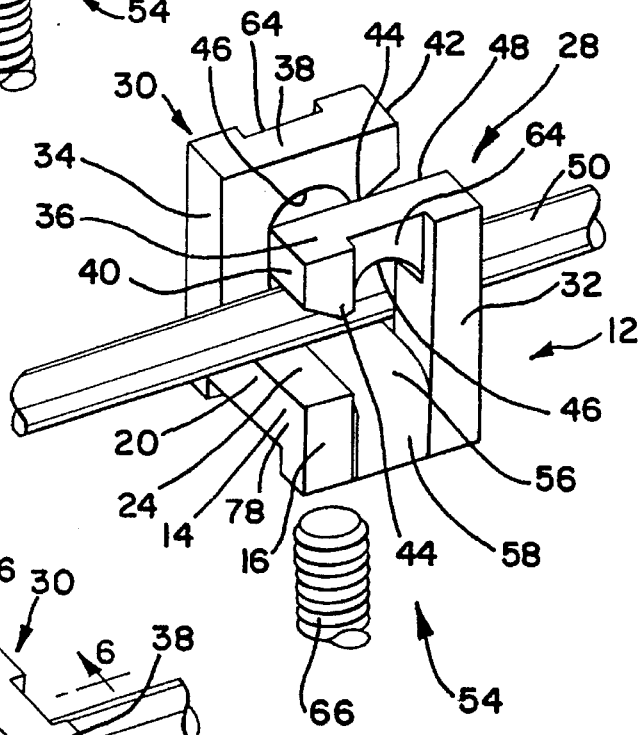

A cable entry slot 48 is defined between the parallel spaced apart arms 36. Slot 48 extends in the X axis direction between the posts 32 and 34. As can be seen by comparing FIGS. 3 and 4, a cable 50 may be aligned with slot 48 (FIG. 3) and the connector 12 and cable 50 can be moved relative to one another so that the cable 50 enters the slot 48 between the arms 38 and 38 and between the posts 32 and 34 until the cable 50 is adjacent the top wall 24 of the base portion 14 and extends in the X axis direction (FIG. 4).

A cable retention path 52 extends in the Y axis direction, perpendicular to the cable entry slot 48. The path 52 is defined in part by the cradles 46 and extends between the posts 32 and 34. As can be seen from a comparison of FIGS. 4 and 5, after the cable 50 has entered the cable entry slot 48 (FIG. 4), the connector 12 can be rotated ninety degrees in the X-Y plane so that the cable 50 extends in the Y axis direction and lies in the cable retention path. Because of the lips 44 and cradles 46, the connector 12 supports itself upon the cable in this position and no continuing engagement by hand or tool is required to prevent the connector from falling off of the cable 50.

Figure 5:
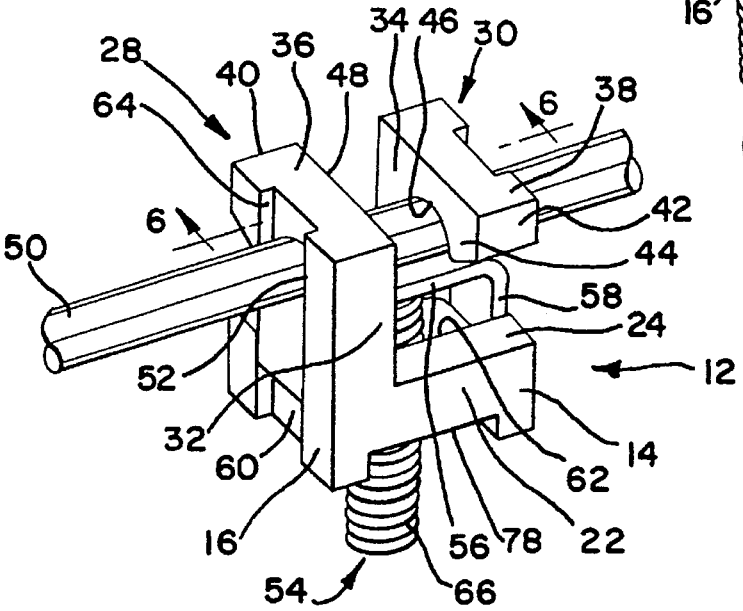
Figure 6:
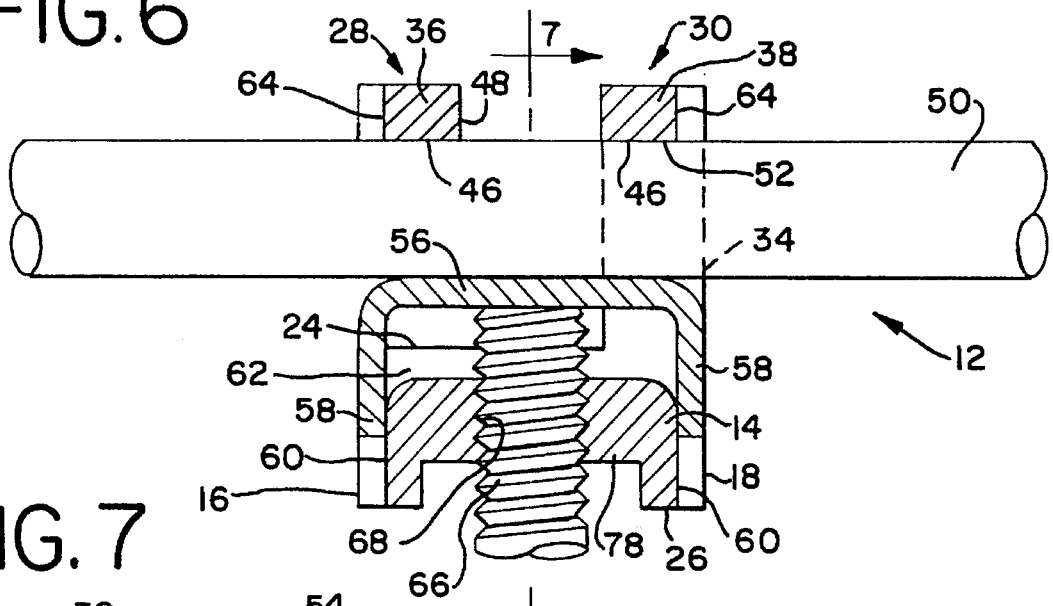
FIG. 6 is an elevational sectional view of the cable connector attached to a cable taken along the line 6—6 of FIG. 5.
Figure 7:
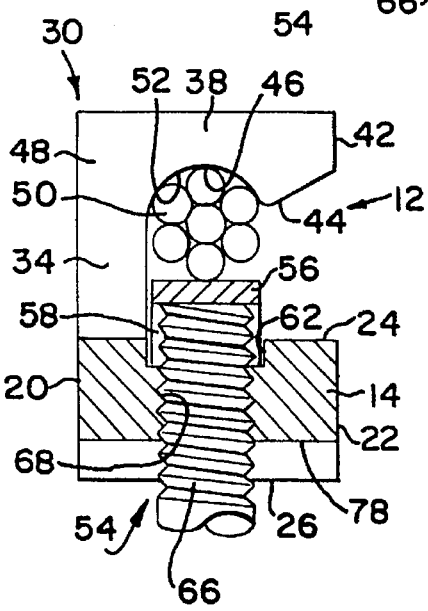
FIG. 7 is an elevational sectional view taken along the line 7—7 of FIG. 6.
Figure 8:
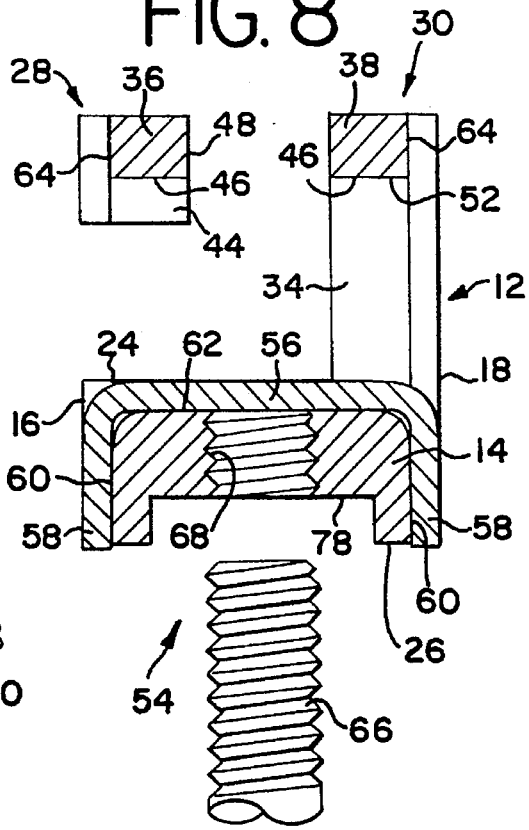
FIG. 8 is a view similar to FIG. 6 illustrating the cable connector prior to attachment to a cable.

A clamping system 54 firmly attaches the cable connector 12 to the cable 50 after the connector is placed onto the cable 50 with the cable 50 in the cable retention path 52. The clamping system 54 includes a clamp plate 56 movable from a cable loading position near the base 14 (FIGS. 3, 4 and 8) to a clamp position wherein the clamp plate 56 firmly holds the cable 50 in the cable retention path 52 against the cradles 46 on the undersides of arms 36 and 38 (FIGS. 5–7).

The clamp plate 56 includes guide portions 58 at its opposed ends. Side walls 16 and 18 of the base portion 14 are provided with guide recesses 60 slidably receiving the guide portions 58 so that the clamp plate is guided in its movement. Top wall 24 is provided with a recess 62 in which the central portion of the clamp plate is received, so that the clamp plate in the cable loading position is flush with the top wall 24. Arms 36 and 38 have access recesses 64 aligned with guide recesses 60 to admit tooling used to form the guide portions 58 after the clamp plate is in place in the recess 62. The guide portions 58 are longer than the clearance below arms 36 and 38 so that the clamp plate cannot be inadvertently removed from the cable connector 12.

A threaded bolt 66 is used to tighten the clamp plate 56 against the cable 50 in the cable retention path 52. Bolt 66 is threaded through a threaded hole 68 located at an axis of symmetry extending through the base portion 14. The base portion 14 and the cable retention structures 28 and 30 are symmetrical about the axis of the threaded hole 68. As a result, when the bolt 66 is rotated to tighten the clamp plate 56 against the cable 50, the resultant forces are balanced and there is no tendency for the connector 12 to become skewed or displaced on the cable 50. When the clamp plate is tightened against the cable, the cable connector 12 is secured at a fixed position along the cable 50.

Returning to FIGS. 1 and 2, the phase cable spacer 10 includes a pair of connectors 12 mounted upon a spacer arm 70. Spacer 10 maintains a desired spacing between a pair of cables 50 so that the cables are not moved into contact by disturbances such as earthquakes or storms. The connectors 12 render it easy to attach the spacer 10 to the cables 50, even with a relatively cumbersome hot stick tool.

Spacer arm 70 is formed of dielectric material in order to maintain electrical isolation between the cables 50. A central portion of the arm 70 has projections 72 to increase the surface length and thus the surface current flow path between ends of the arm 70. A series of attachment holes 74 at both ends of the arm 70 permits the spacing between connectors 12 to be tailored to a variety of phase cable spacings.

In the application of FIGS. 1 and 2, the bolts 66 are eye bolts having eyes 76. An advantage of this configuration is that the eyes 76 can easily be engaged, manipulated and rotated by an electrically nonconductive hot stick tool to permit the spacer 10 to be installed on live or energized phase cables.

The bottom wall 26 of the connector 12 has a recessed slot 78 extending in the X axis direction between the opposed end walls 20 and 22. The arm 70 has a rail 80 defined on its upper surface between a spaced pair of grooves 82. The rail is sized to be received in the slot 78. When the rail 86 is mated with the slot 84, the connector 12 cannot be rotated relative to the arm.

In order to install the spacer 10, a pair of cable connectors 12 are mounted at two selected attachment holes 74 of the arm 70. The holes 74 are selected to match the spacing between connectors 12 with the spacing between cables 50. The ends of bolts 66 are threaded part way but not entirely through the base portions 14, and the clamp plates 56 are in their recessed positions. A nut 84 and a pair of washers 86 separated by a spring 88 are received on the shank of bolt 66 between the arm 70 and eye 76. The nut is positioned so that the spring 82 is compressed sufficiently to apply a frictional force between the base portion 14 and the arm 70, thereby to prevent inadvertent rotation of the connector 12 relative to the arm 70.

Initially the connectors 12 are oriented so that the X axis direction, and the direction of the cable entry slots 48, are perpendicular to the arm 70 and the rail 80. In this initial position the rail 80 is perpendicular to the slots 78, and the connectors 12 can be rotated if the frictional force resulting from spring 88 is overcome. In this position, the cable entry slots are parallel to the cables 50 when the arm 70 is perpendicular to the cables 50.

The arm 70 is moved relative to the cables 50 so that the cables 50 are received in the entry slots 48 of the connectors 12. Then each connector 12 is rotated ninety degrees by turning the eye 76 of bolt 66. In the rotated position, the cable 50 is received in the cable retention path 52 of the connector 12. When the slot 78 is aligned with the rail 80, the force of spring 88 causes the rail 80 to seat in the slot 78, locking the connector against further rotation. Continued turning of the eye 76 advances the threaded bolt 66 through the threaded hole 68 in the base portion 14 and the cable is clamped by the clamp plate 56.

Figure 9:
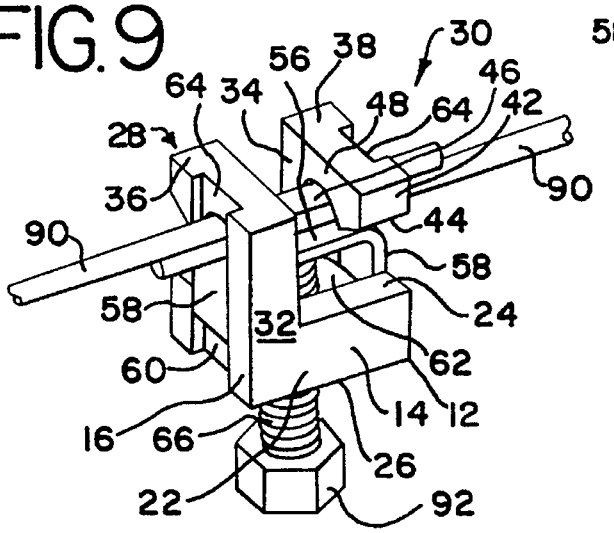
FIG. 9 is an isometric view of an alternative embodiment of a cable connector used to splice two cables together.

FIG. 9 illustrates another application of the cable connector 12. Here the connector 12 is used to splice together two cables 90. The two cables are clamped in side by side relation between the clamp plate 56 and the cradles 46. The splice connection may be mechanical only, or may be electrical and mechanical. In the embodiment of FIG. 9, the tool engagement portion of the bolt 66 has a hex head 92 rather than an eye 76.

While the present invention has been described with reference to the details of the embodiments of the invention shown in the drawings, these details are not intended to limit the scope of the invention as claimed in the appended claims.

What is claimed is:

1. A cable connector for attachment to a cable and comprising:

a base lying in an X-Y plane of a generally orthogonal X-Y coordinate system;

a pair of cable retention structures each including an upstanding post and a cable retention arm extending from said post;

said upstanding posts extending from said base at locations spaced apart from one another along both the X and Y axes;

said cable retention arms being spaced from said base and being generally parallel to one another and extending from said posts in opposite X axis directions;

each cable retention arm having a free end opposed in the Y direction from said post of the other cable retention structure;

a cable entry slot extending in the X axis direction between said cable retention arms and between said posts;

a cable retention path extending in the Y axis direction above said base and beneath said cable retention arms and between said posts; and means for clamping a cable against said cable retention arms.

2. A cable connector as claimed in claim 1, said base and said cable retention structures being unitary and of one piece.

3. A cable connector as claimed in claim 2, said base and said cable retention structures being metal.

4. A cable connector as claimed in claim 1, said arms including lips at said free ends extending toward said base for retaining the cable in said cable retention path.

5. A cable connector as claimed in claim 4, said arms and lips defining cable retention cradles disposed on the undersides of said arms.

6. A cable connector as claimed in claim 1, said clamping means comprising a clamp plate supported on said base for movement from said base toward said arms and into said cable retention path.

7. A cable connector as claimed in claim 6, said clamping means further comprising threaded clamp actuator threaded through said base and engageable with said clamp plate for moving said clamp plate.

8. A cable connector as claimed in claim 7, said cable retention structures being symmetrical about a vertical axis extending through said base and said clamp actuator being aligned with said vertical axis.

9. A cable connector as claimed in claim 7, said clamp actuator comprising a bolt.

10. A cable connector as claimed in claim 9, said bolt comprising a hex head bolt.

11. A cable connector as claimed in claim 9, said bolt comprising an eye bolt.

12. A cable connector as claimed in claim 6, said base including a recess and said clamp plate being received in said recess in the lowermost position of said clamp plate.

13. A cable connector as claimed in claim 6, said clamp plate including a central portion generally parallel to said base and a pair of guide portions generally perpendicular to said base, said base including a pair of guide recesses slidably receiving said guide portions.

14. A cable spacer for maintaining a space between a pair of cables such as primary phase cables, said spacer comprising a spacer arm and first and second cable connectors supported at spaced locations along said arm, said first and second cable connectors being as claimed in claim 1.

15. A cable spacer for maintaining a space between a pair of cables such as primary phase cables, said spacer comprising a spacer arm and first and second cable connectors supported at spaced locations along said arm, said first and second cable connectors being as claimed in claim 9.

16. A cable spacer as claimed in claim 15, said spacer arm including a plurality of spaced holes, and said bolts of said cable connectors extending through a pair of said holes selected to define a desired spacing between said pair of cables.

17. A cable spacer as claimed in claim 15, said bolts comprising eye bolts having an eye and a shank, said eye and said cable retention structures being on opposite sides of said base.

18. A cable spacer as claimed in claim 17 further comprising interlock means formed on said base portion and said arm for preventing rotation of said connector relative to said arm.

19. An assembly of spliced cables comprising a cable connector as claimed in claim 1 and a pair of cables clamped in abutting side by side relation in said cable retention path.

* * * * *